US007380682B2

(12) United States Patent
Lin

(10) Patent No.: US 7,380,682 B2
(45) Date of Patent: Jun. 3, 2008

(54) GARBAGE BIN

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 338 days.

(21) Appl. No.: 10/884,456

(22) Filed: Jul. 2, 2004

(65) Prior Publication Data

US 2006/0000834 A1 Jan. 5, 2006

(51) Int. Cl.
*B65D 43/26* (2006.01)

(52) U.S. Cl. ..... 220/263; 220/908; 220/262; 220/264; 220/244

(58) Field of Classification Search ..... 220/244, 220/262, 263, 264, 908
See application file for complete search history.

(56) References Cited

U.S. PATENT DOCUMENTS

| | | | | |
|---|---|---|---|---|
| 2,071,486 | A * | 2/1937 | Wright | 220/263 |
| 2,475,125 | A * | 7/1949 | Brownell | 220/263 |
| 2,910,206 | A * | 10/1959 | Hodgson | 220/23.87 |
| 2,946,474 | A * | 7/1960 | Knapp | 220/23.87 |
| 4,785,964 | A * | 11/1988 | Miller et al. | 220/263 |
| 5,474,201 | A * | 12/1995 | Liu | 220/23.87 |
| 5,881,896 | A * | 3/1999 | Presnell et al. | 220/252 |
| 5,884,556 | A * | 3/1999 | Klepacki et al. | 100/349 |
| 6,010,024 | A * | 1/2000 | Wang | 220/23.87 |
| 6,345,725 | B1 * | 2/2002 | Lin | 220/263 |
| 6,626,316 | B2 * | 9/2003 | Yang | 220/263 |
| 6,626,317 | B2 * | 9/2003 | Pfiefer et al. | 220/263 |
| 6,920,994 | B2 * | 7/2005 | Lin | 220/264 |
| D518,266 | S * | 3/2006 | Yang et al. | D34/9 |
| 7,044,323 | B2 * | 5/2006 | Yang et al. | 220/263 |
| 7,077,283 | B2 * | 7/2006 | Yang et al. | 220/262 |
| 2001/0020619 | A1 * | 9/2001 | Pfeifer et al. | 220/263 |
| 2002/0079315 | A1 * | 6/2002 | Yang | 220/263 |
| 2004/0016756 | A1 * | 1/2004 | Lin | 220/263 |
| 2004/0020927 | A1 * | 2/2004 | Yang et al. | 220/262 |
| 2005/0006536 | A1 * | 1/2005 | Yang et al. | 248/99 |
| 2005/0103788 | A1 * | 5/2005 | Yang et al. | 220/263 |
| 2006/0144839 | A1 * | 7/2006 | Yang et al. | 220/263 |
| 2006/0186121 | A1 * | 8/2006 | Yang et al. | 220/263 |

* cited by examiner

*Primary Examiner*—Anthony Stashick
*Assistant Examiner*—Christopher McKinley
(74) *Attorney, Agent, or Firm*—Alan Kamrath; Kamrath & Associates PA

(57) ABSTRACT

A garbage bin includes a base. A barrel is installed on the base and defines two apertures. A cover is pivotally installed on the barrel. A pedal is pivotally installed on the barrel and includes an external member and an internal member. The external member of the pedal is put outside the barrel and formed with two ends inserted in the barrel through the apertures. The internal member of the pedal is put in the barrel and formed with two ends connected with the ends of the external member. Linkage is provided between the cover and the internal member of the pedal.

10 Claims, 9 Drawing Sheets

GARBAGE BIN

BACKGROUND OF INVENTION

1. Field of Invention

The present invention relates to a garbage bin and, more particularly, to a pedal of a garbage bin.

2. Related Prior Art

Referring to FIG. 9, a conventional garbage bin includes a barrel 110 that includes a rear half 111 and a front half 111. Two connecting assemblies 200 are used to hold the halves 111 together. A bottom 120 is provided below the barrel 110. A semi-circular protector 130 is installed on the upper edge of each half Ill by fasteners 132 and tabs 3. A cover 140 is pivotally installed on the barrel 110. An arched pedal 160 includes an intermediate portion formed between two terminal sections. A shaft 161 transversely extends from each terminal section of the arched pedal 160. The rear half 111 defines two apertures 115 for receiving the shafts 161. The front half 111 defines two slots 116 for encompassing the pivotal movement of the terminal sections of the arched pedal 160. Linkage 150 is used to connect the cover 140 with the pedal 160. A pad 170 is attached to the barrel 110 below the arched pedal 160. The slots 116, however, entail degradation of the rigidity of the barrel 110.

The present invention is therefore intended to obviate or at least alleviate the problems encountered in the prior art.

SUMMARY OF INVENTION

According to the present invention, a garbage bin includes a base. A barrel is installed on the base and defines two apertures. A cover is pivotally installed on the barrel. A pedal is pivotally installed on the barrel and includes an external member and an internal member. The external member of the pedal is put outside the barrel and formed with two ends inserted in the barrel through the apertures. The internal member of the pedal is put in the barrel and formed with two ends connected with the ends of the external member. Linkage is provided between the cover and the internal member of the pedal.

The primary advantage of the garbage bin according to the present invention is that the apertures cause little degradation of the strength of the barrel.

Other objects, advantages and novel features of the present invention will become more apparent from the following detailed description referring to the attached drawings.

BRIEF DESCRIPTION OF DRAWINGS

The present invention will be described via detailed illustration of embodiments referring to the drawings.

DETAILED DESCRIPTION OF EMBODIMENTS

FIGS. 1 to 5 show a garbage bin according to a first embodiment of the present invention.

Figure 1:
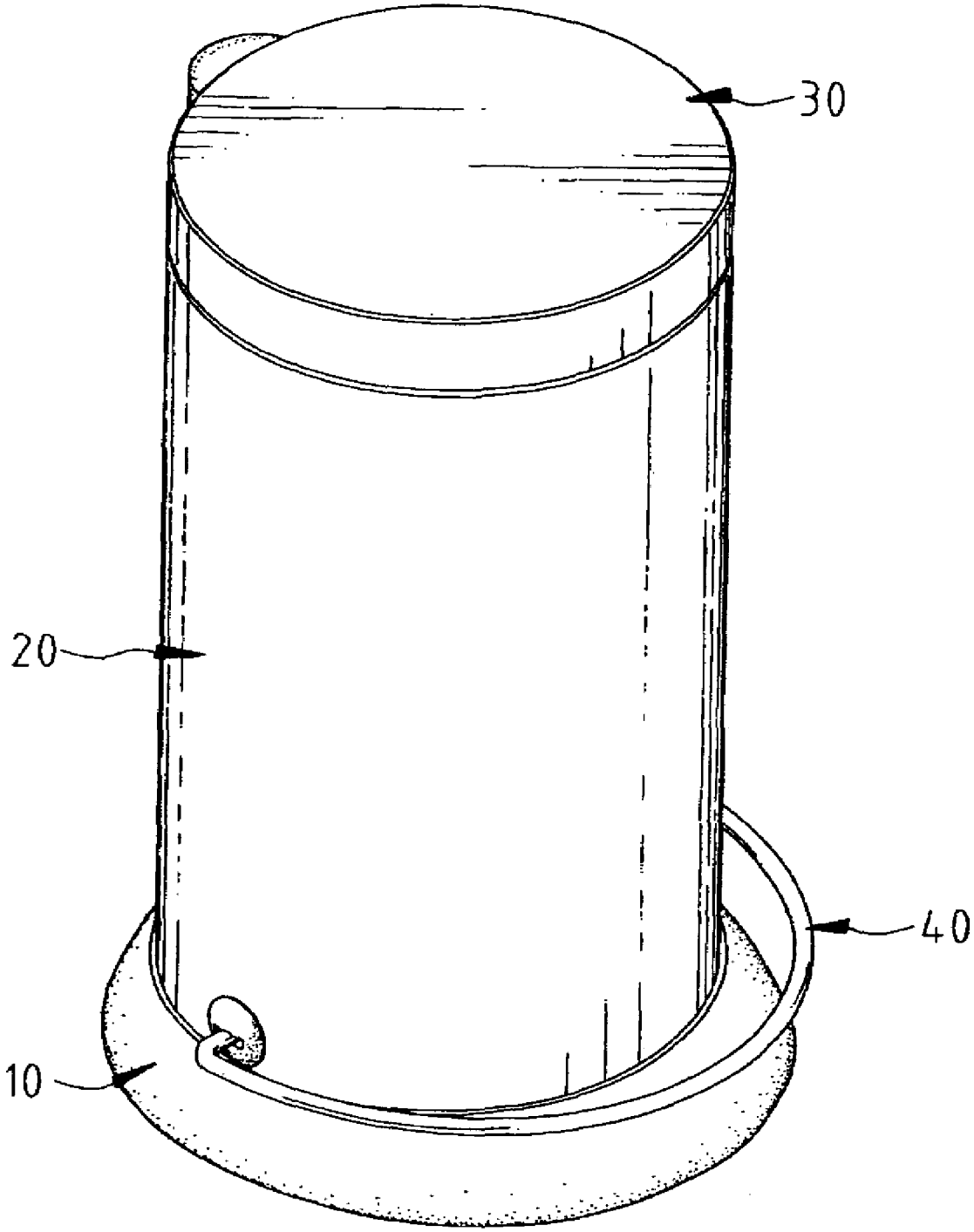
FIG. 1 is a perspective view of a garbage bin according to a first embodiment of the present invention.

Referring to FIG. 1, the garbage bin includes a base 10, a barrel 20 installed on the base 10, a cover 30 pivotally installed on an upper portion of the barrel 20 and a pedal 40 pivotally installed on a lower portion of the barrel 20.

Figure 2:
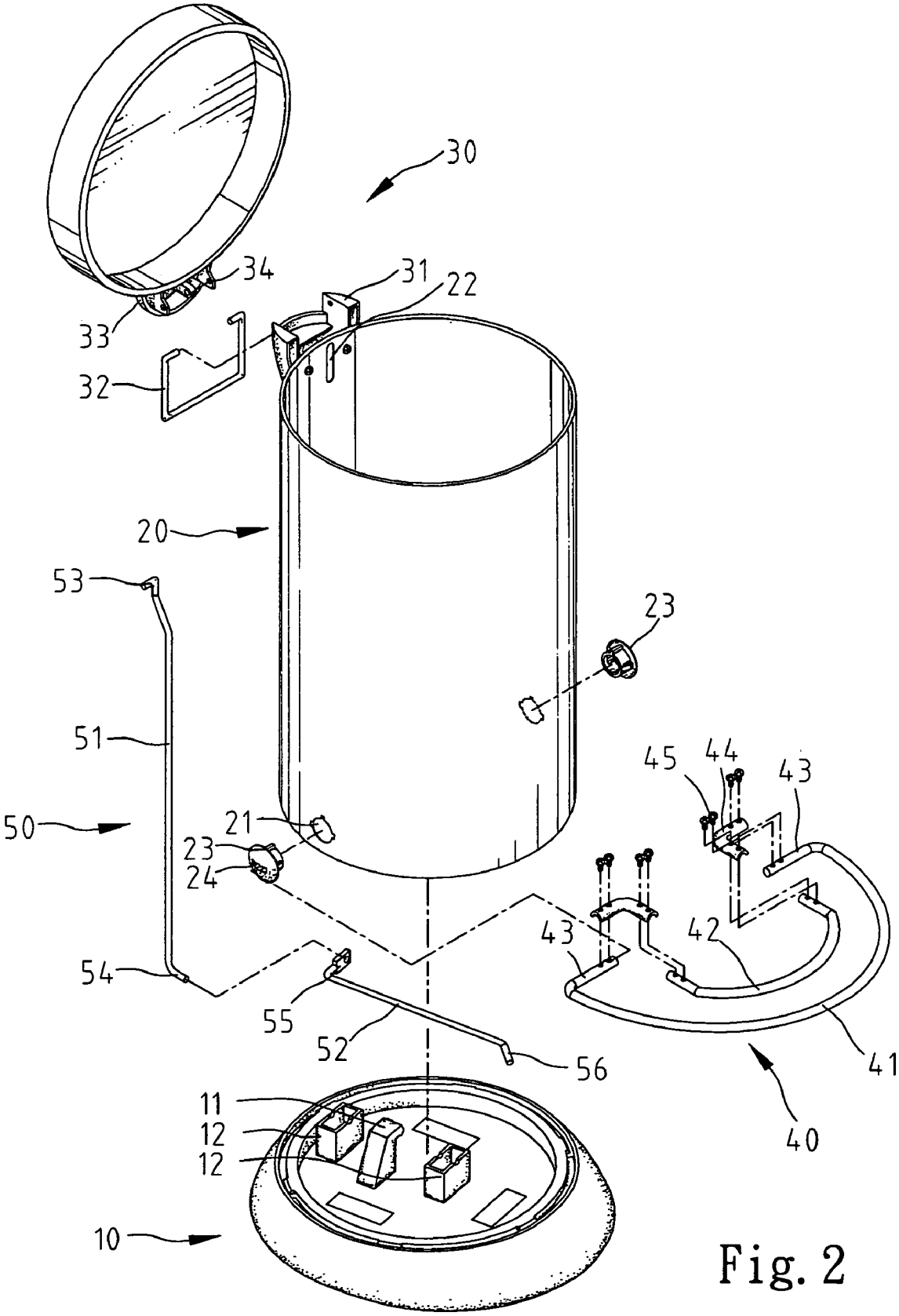
FIG. 2 is an exploded view of the garbage bin shown in FIG. 1.
Figure 3:
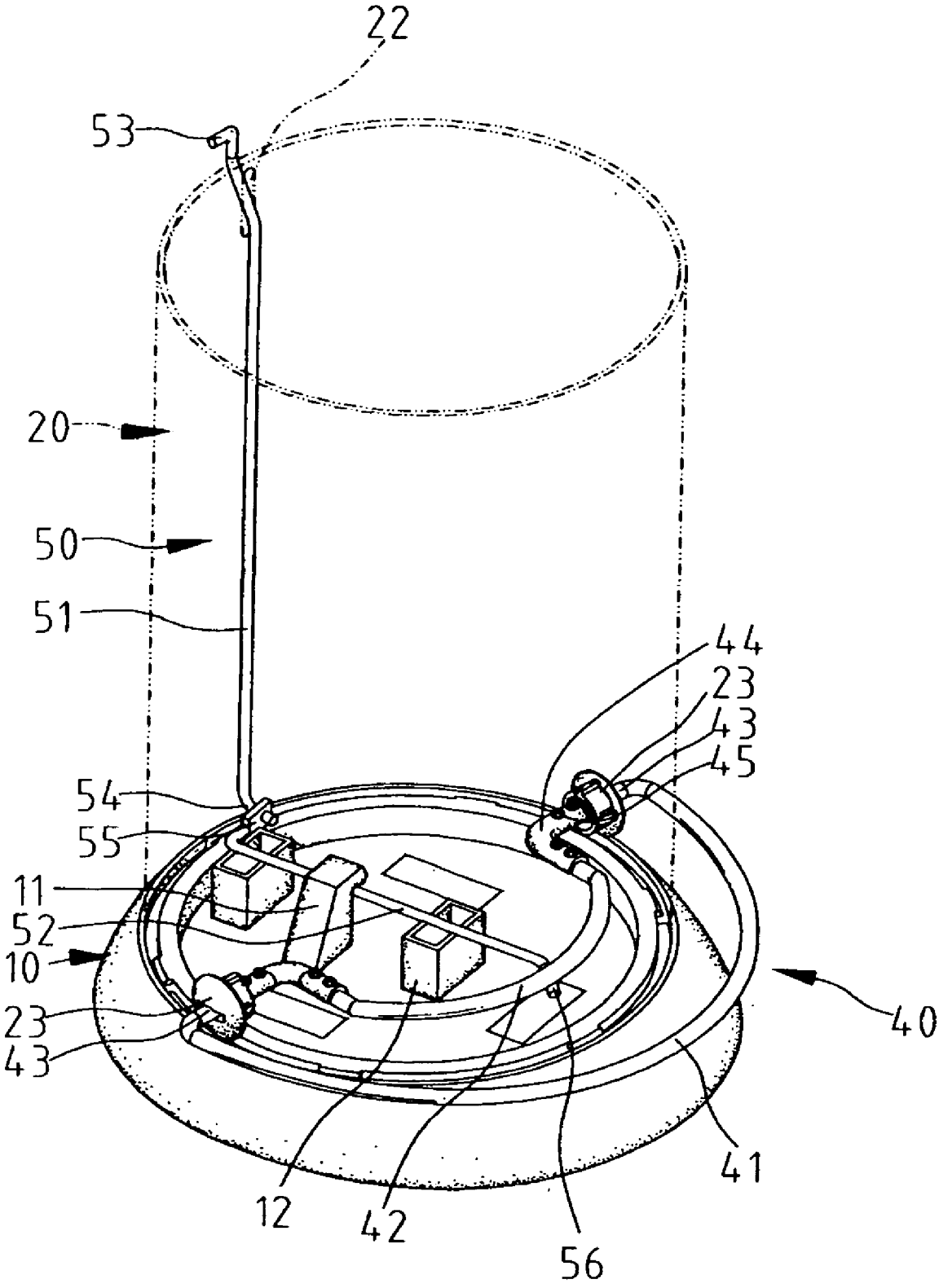
FIG. 3 is a partial view of the garbage bin shown in FIG. 1.

Referring to FIGS. 2 and 3, linkage 50 is used to connect the cover 30 with the pedal 40 so that the cover 30 can be lifted through treading the pedal 40. The linkage 50 includes a rod 51 and a shaft 52. The rod 51 includes an upper end 53 extending through an elongated slot 22 formed in the barrel 20 and connected with the cover 30 and a lower end 54. The shaft 52 includes a transverse rear end 55 connected with the lower end 54 of the rod 51 and a transverse front end 56 connected with the pedal 40.

A bearing is provided on the base 10 for the shaft 52. The bearing includes a hook 11 for exerting a downward force on the shaft 52 and two abutments 12 for exerting upward forces on the shaft 52.

The cover 30 is pivotally installed on the upper portion of the barrel 20 by a hinge. The hinge includes two ears 31 secured to the barrel 20, two ears 33 formed on the cover 30 and a C-clip 32 with two ends inserted in the ears 31 and 33. A lug 34 is formed on the cover 30 in order to receive the upper end 53 of the rod 51.

The barrel 20 defines two apertures 21 in the lower portion. Two bearings 23 are fit in the apertures 21. Each bearing 23 defines an aperture 24.

The pedal 40 includes a semi-circular external member 41 put in the exterior of the barrel 20 and a semi-circular internal member 42 put in the barrel 20. The semi-circular external member 41 can be trodden. The semi-circular member 42 is in contact with the transverse front end 56 of the shaft 52. The semi-circular external member 41 includes two transverse ends 43 inserted into the barrel 20 through the apertures 24 defined in the bearings 23. Each transverse end 43 of the semi-circular external member 41 is connected with an end of the semi-circular internal member 42 by an L-shaped connector 44 and screws 45.

Figure 9:
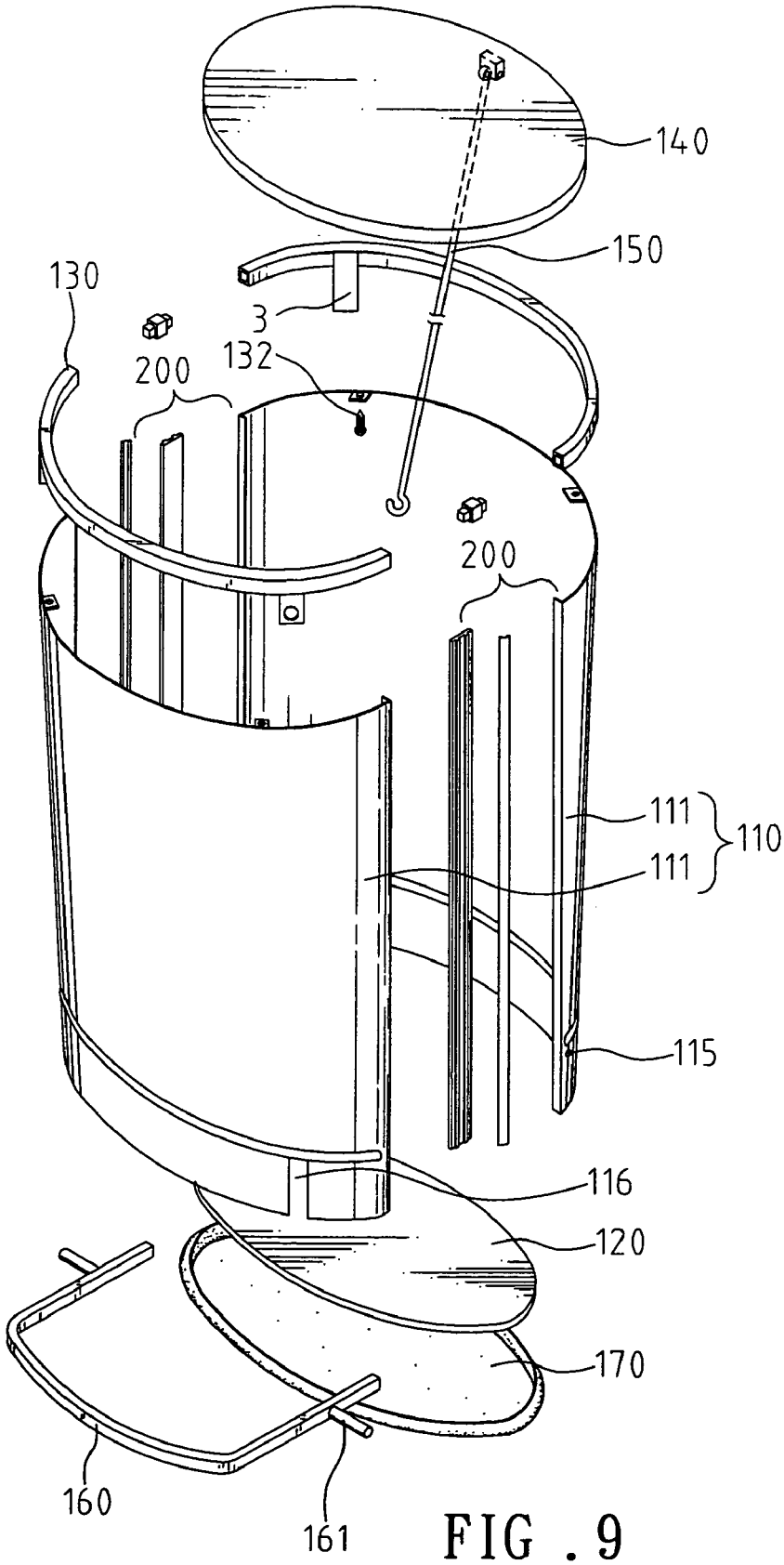
FIG. 9 PRIOR ART
FIG. 9 is an exploded view of a conventional garbage bin.

Obviously, the apertures 21 cause less degradation to the strength of the barrel 20 than the slots 116 to the barrel 110 of the conventional garbage bin discussed in the Related Prior Art referring to FIG. 9.

Figure 4:
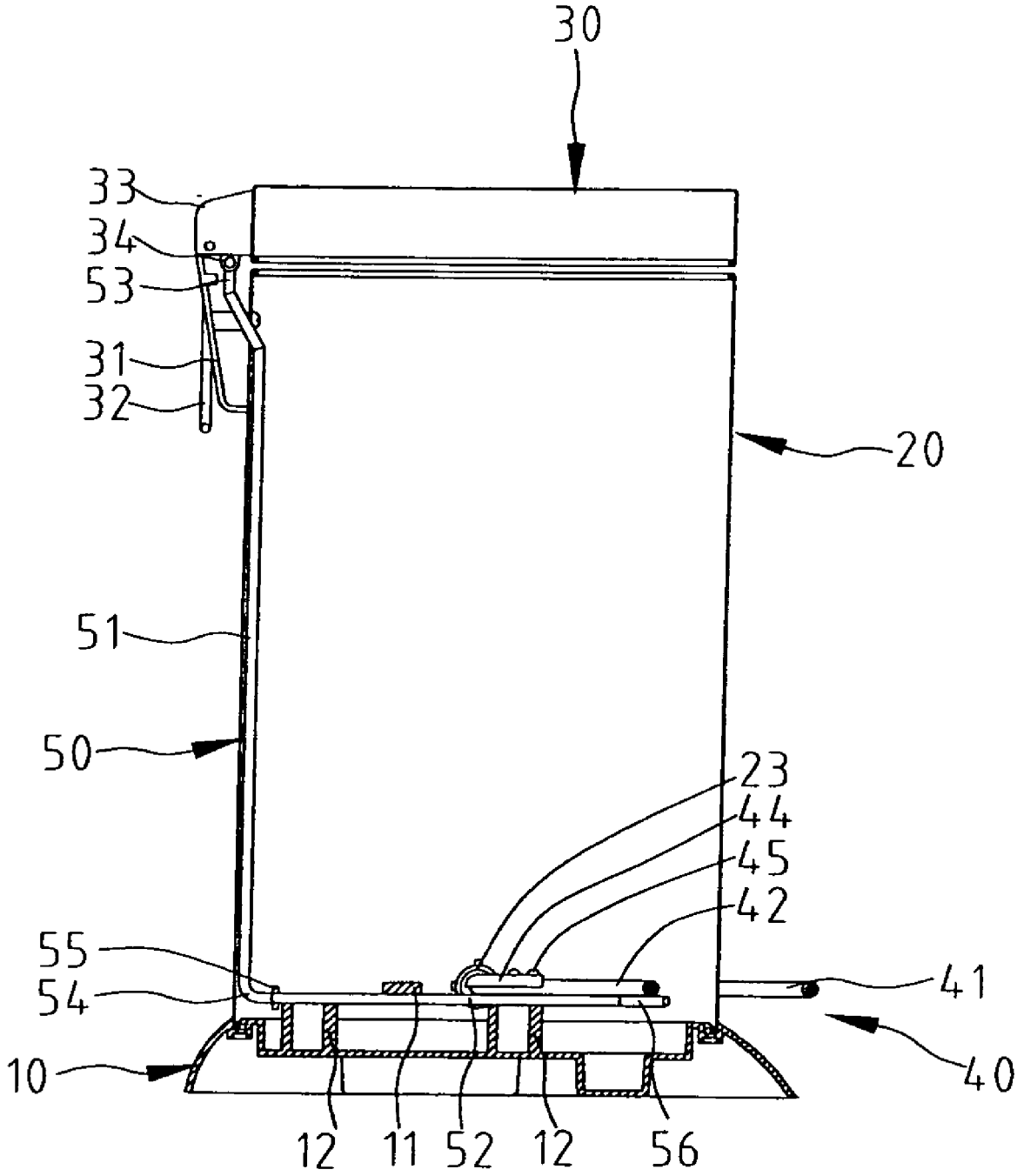
FIG. 4 is a cross-sectional view of the garbage bin shown in FIG. 1.
Figure 5:
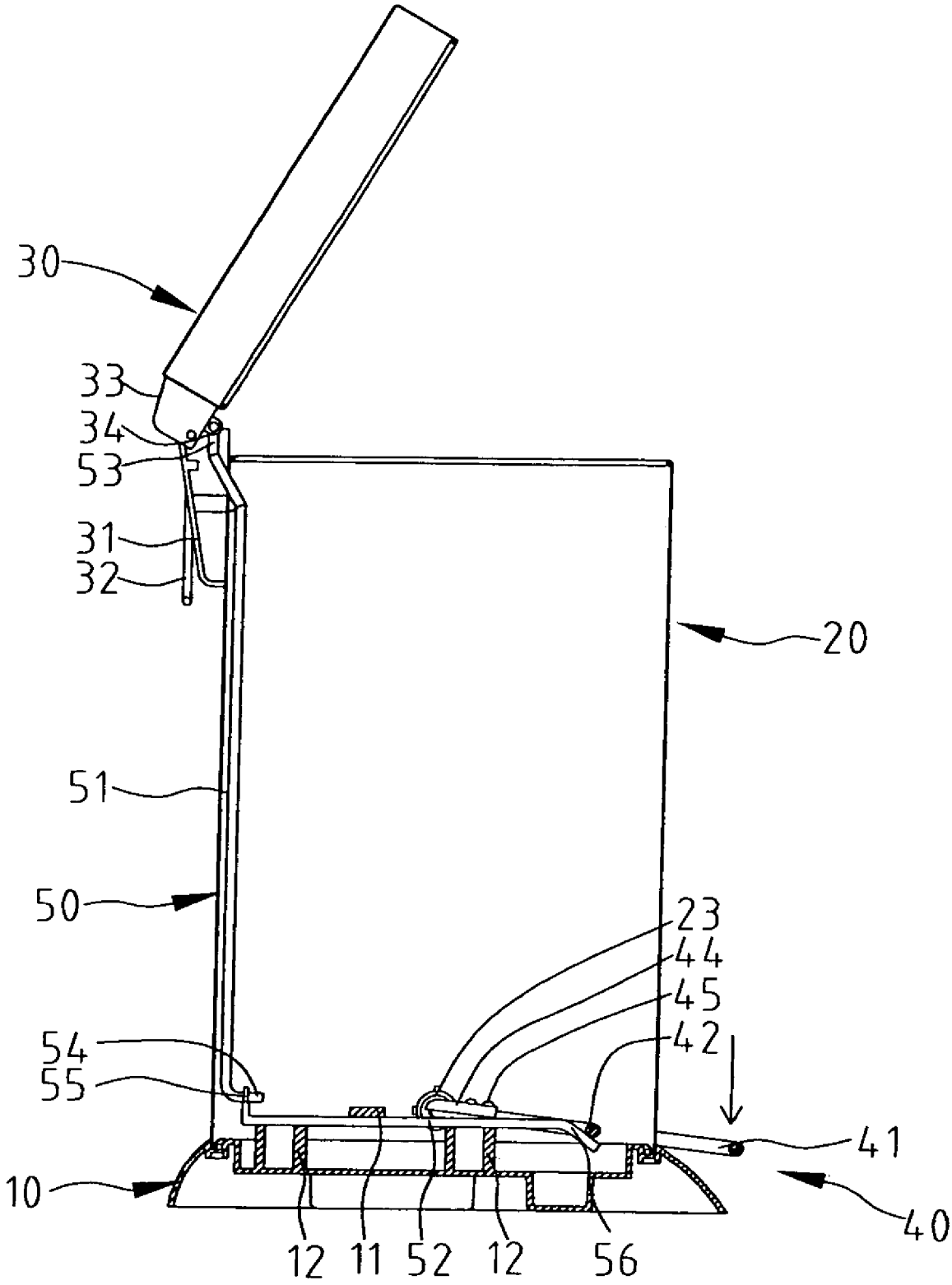
FIG. 5 is similar to FIG. 4 but shows a lid lifted.

Referring to FIGS. 4 and 5, the cover 30 can be lifted via treading the pedal 40 due to connection with each other by the linkage 50.

Figure 6:
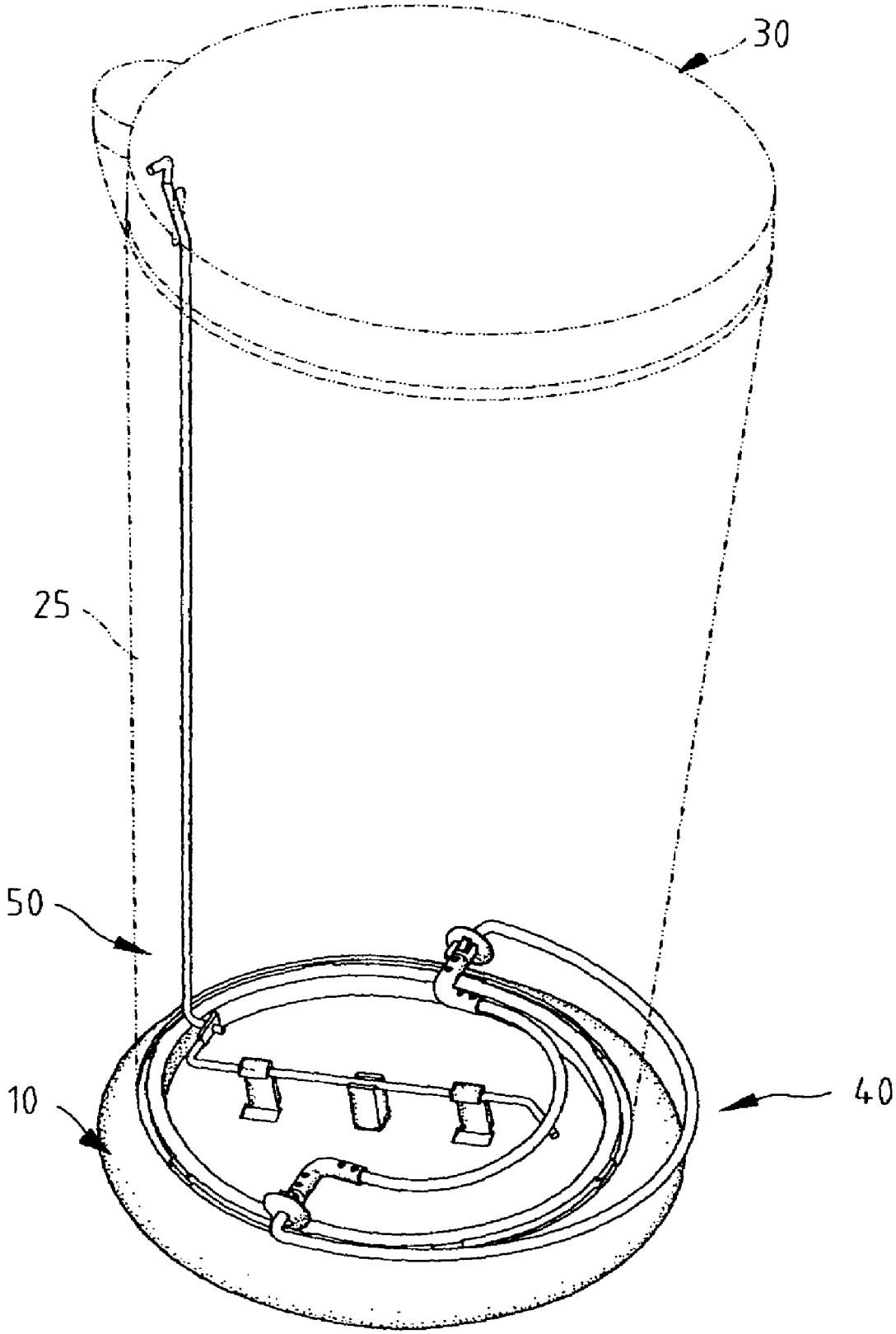
FIG. 6 is a perspective view of a garbage bin according to a second embodiment of the present invention.

FIG. 6 shows a garbage bin according to a second embodiment of the present invention. The second embodiment is similar to the first embodiment except for including a barrel 25 that includes a small lower end and a large upper end.

Figure 7:
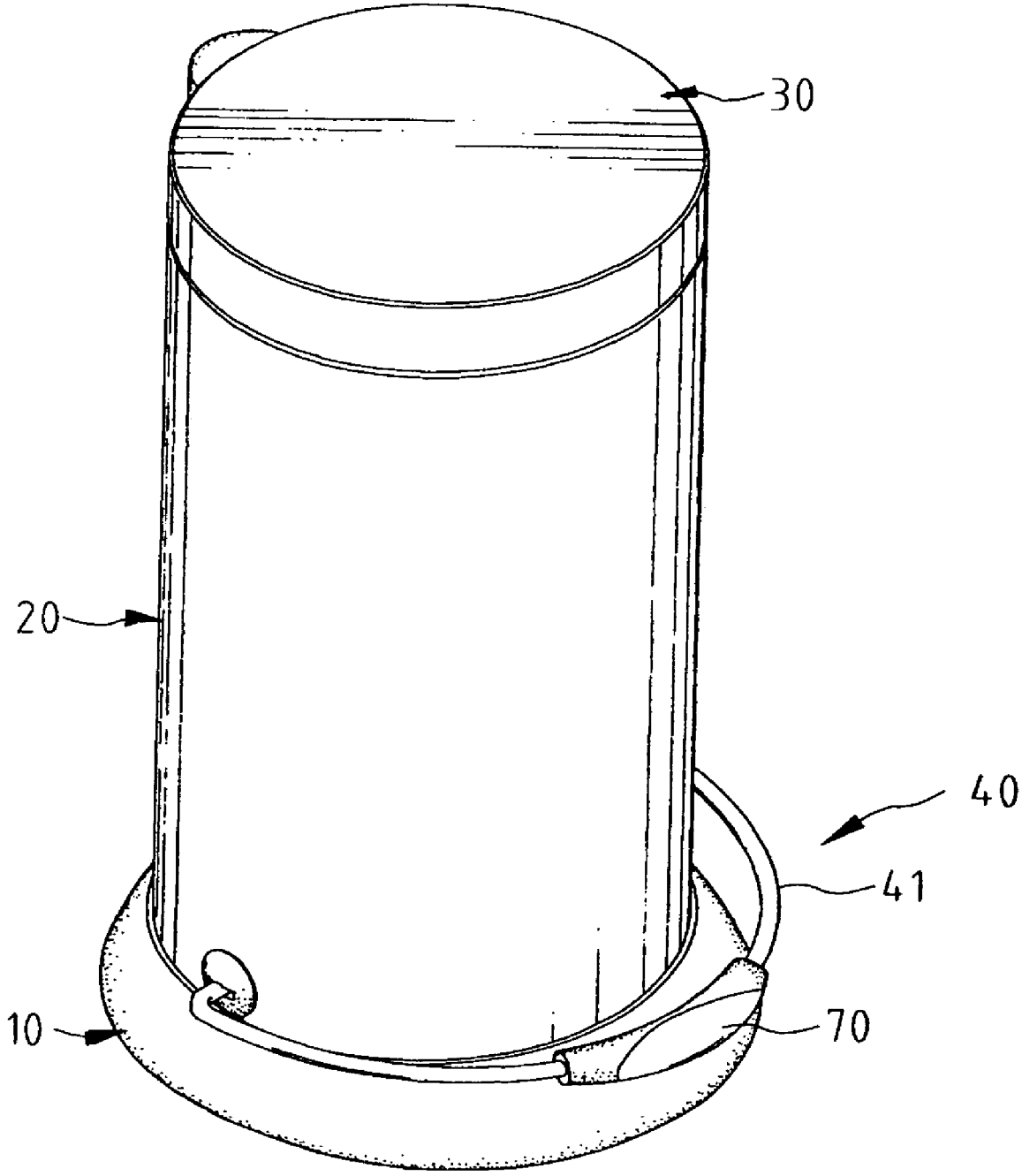
FIG. 7 is a perspective view of a garbage bin according to a third embodiment of the present invention.

FIG. 7 shows a garbage bin according to a third embodiment of the present invention. The third embodiment is similar to the first embodiment except for including an anti-slip element 70 installed on the semi-circular external member 41.

Figure 8:
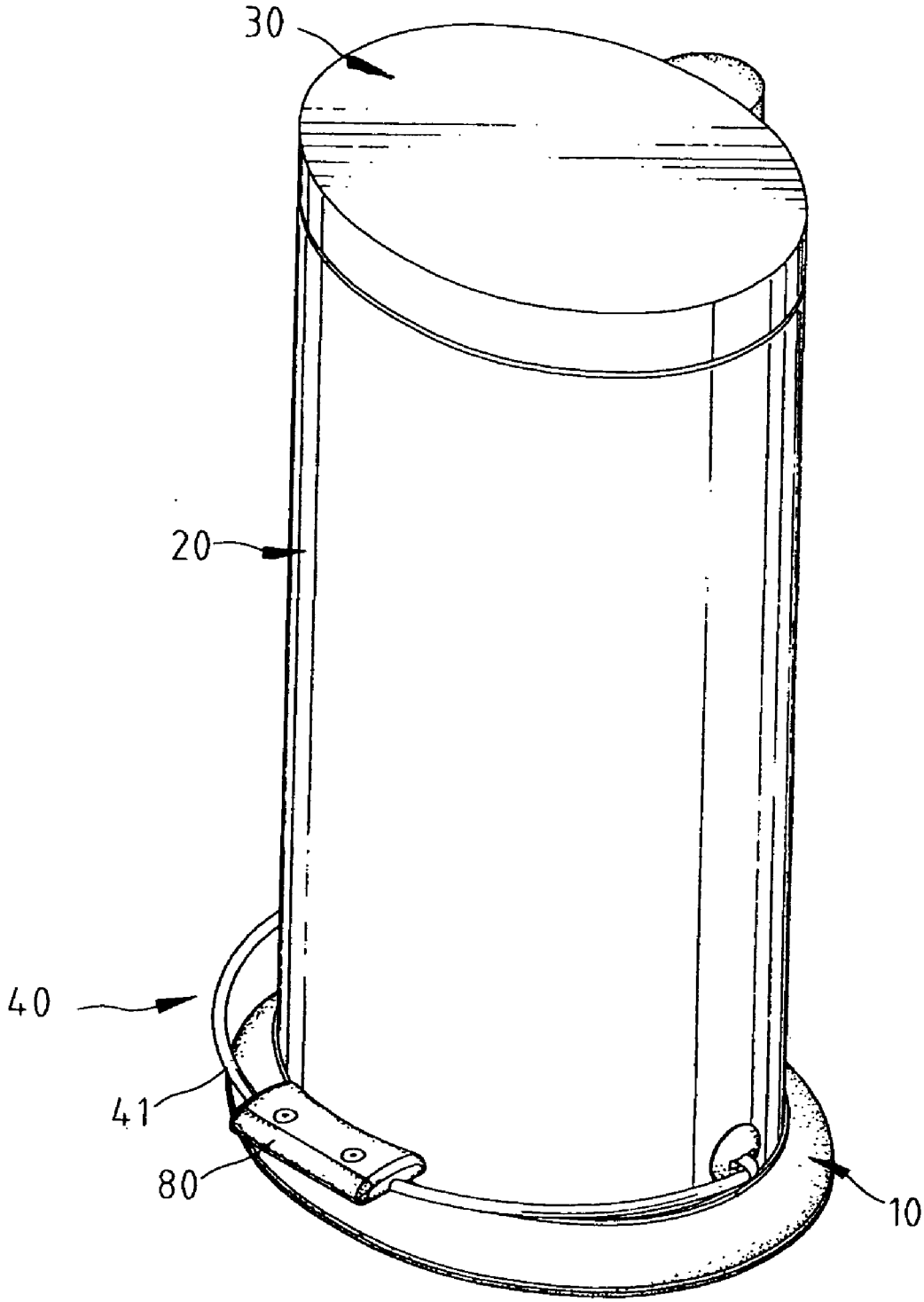
FIG. 8 is a perspective view of a garbage bin according to a fourth embodiment of the present invention.

FIG. 8 shows a garbage bin according to a fourth embodiment of the present invention. The fourth embodiment is similar to the third embodiment except for including another anti-slip element 80 than the anti-slip element 70.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A garbage bin comprising:

a base;

a barrel installed on the base and having two apertures on a side wall of the barrel;

a cover pivotally installed on the barrel;

a pedal pivotally installed on the barrel and comprising:

an external member put outside the barrel and formed with two ends inserted in the barrel through the apertures, with the two ends extending towards each other from the external member along a pivot axis, with the ends inserted in the apertures pivotally installing the pedal on the barrel; and an internal member put in the barrel and formed with two ends connected with the ends of the external member;

linkage provided between the cover and the internal member of the pedal; and two bearings fit in the apertures for bearing the ends of the external member of the pedal.

2. The garbage bin according to claim 1 wherein the pedal comprises two connectors for connecting the ends of the external member with the ends of the internal member.

3. The garbage bin according to claim 2 wherein each of the connectors comprises an L-shaped configuration including a first leg receiving one of the ends of the external member and a second leg receiving one of the ends of the internal member, with the first leg extending along the pivot axis and the second leg extending generally perpendicular to the pivot axis.

4. The garbage bin according to claim 3 comprising screws driven in each of the connectors, corresponding one of the ends of the external member and corresponding one of the ends of the internal member.

5. The garbage bin according to claim 1 comprising an anti-slip element installed on the external member of the semi-circular structure, with the anti-slip element having cross sections larger than the semi-circular structure.

6. A garbage bin comprising:

a base;

a barrel installed on the base and having two apertures on a side wall of the barrel;

a cover pivotally installed on the barrel;

a pedal pivotally installed on the barrel and comprising:

an external member put outside the barrel and formed with two ends inserted in the barrel through the apertures, with the two ends extending towards each other from the external member alone a pivot axis, with the ends inserted in the apertures pivotally installing the pedal on the barrel; and an internal member put in the barrel and formed with two ends connected with the ends of the external member; and linkage provided between the cover and the internal member of the pedal, wherein the linkage comprises:

a rod comprising an upper end connected with the cover and a lower end; and a shaft comprising a transverse rear end connected with the lower end of the rod and a transverse front end in contact with the internal member of the pedal.

7. The garbage bin according to claim 6 wherein the cover comprises a lug connected with the upper end of the rod.

8. The garbage bin according to claim 1 comprising a hinge for pivotally connecting the cover with the barrel.

9. A garbage bin comprising:

a base;

a barrel installed on the base and having two apertures on a side wall of the barrel;

a cover pivotally installed on the barrel;

a pedal pivotally installed on the barrel and comprising:

an external member put outside the barrel and formed with two ends inserted in the barrel through the apertures; and an internal member put in the barrel and formed with two ends connected with the ends of the external member;

linkage provided between the cover and the internal member of the pedal; and a hinge for pivotally connecting the cover with the barrel, wherein the hinge comprises two ears formed on the cover, two cars provided on the barrel and a C-clip comprising two transverse ends each inserted in corresponding one of the ears formed on the cover and corresponding one of the ears provided on the barrel.

10. A garbage bin comprising:

a base;

a barrel installed on the base and having two apertures on a side wall of the barrel;

a cover pivotally installed on the barrel;

a pedal pivotally installed on the barrel and comprising:

an external member put outside the barrel and formed with two ends inserted in the barrel through the apertures; and an internal member put in the barrel and formed with two ends connected with the ends of the external member; and linkage provided between the cover and the internal member of the pedal, wherein the internal member comprises a semi-circular structure.

* * * * *